US006213112B1

(12) United States Patent
Squire

(10) Patent No.: US 6,213,112 B1
(45) Date of Patent: Apr. 10, 2001

(54) BOLT FOR A PAINT BALL GUN

(76) Inventor: Ari M. Squire, 28031 N. Lakeview, Wauconda, IL (US) 60084

( * ) Notice: Subject to any disclaimer, the term of this patent is extended or adjusted under 35 U.S.C. 154(b) by 0 days.

(21) Appl. No.: 09/545,970

(22) Filed: Apr. 10, 2000

Related U.S. Application Data

(63) Continuation of application No. 09/135,273, filed on Aug. 17, 1998, now abandoned.

(51) Int. Cl.[7] ..... F41B 11/06
(52) U.S. Cl. ..... 124/74; 124/81
(58) Field of Search ..... 124/56, 71, 73, 124/74, 76, 77, 81, 82

(56) References Cited

U.S. PATENT DOCUMENTS

| | | | | |
|---|---|---|---|---|
| 1,266,764 | * | 5/1918 | Blair | 124/81 |
| 1,299,901 | * | 4/1919 | Blair | 124/76 |
| 3,662,729 | * | 5/1972 | Henderson | 124/73 |
| 5,280,778 | * | 1/1994 | Kotsiopoulos | 124/73 |
| 5,462,042 | * | 10/1995 | Greenwell | 124/76 |
| 5,505,188 | * | 4/1996 | Williams | 124/74 |
| 5,572,982 | * | 11/1996 | Williams | 124/74 |
| 5,655,510 | * | 8/1997 | Kunimoto | 124/81 |
| 5,673,679 | * | 10/1997 | Walters | 124/53.5 |
| 5,823,173 | * | 10/1998 | Slonaker et al. | 124/56 |
| 5,881,707 | * | 3/1999 | Gardner, Jr. | 124/77 |

* cited by examiner

*Primary Examiner*—Michael J. Carone
*Assistant Examiner*—James S. Bergin
(74) *Attorney, Agent, or Firm*—Mathew R. P. Perrone, Jr.

(57) ABSTRACT

A shaped bolt with the same outside appearance as a standard bolt for a paint ball gun has a torpedo shape or flanged end adjacent to the air supply, and a trifurcated flow end or cross-flow end oppositely disposed from flanged end.

6 Claims, 2 Drawing Sheets

BOLT FOR A PAINT BALL GUN

CROSS-REFERENCE TO RELATED APPLICATION

This application is a continuation of U.S. Nonprovisional patent application Ser. No. 09/135,273 of the same title, filed on Aug. 17, 1998, now abandoned.

BACKGROUND OF THE INVENTION

This invention relates to a paint ball gun and more particularly to a paint ball gun, with a propelling bolt having a shaped end for improving the air flow in order to more efficiently discharge the ball from the paint ball gun.

In the close relation between sport and conflict, it is desired to provide excitement in the sport and permit training for a conflict without substantial danger. The conflict sometimes involves shooting a projectile at one another. Sport can sometimes also involve physical contact.

Sport and training can be obtained in a conflict situation by providing shooting devices, which do not inflict fatal wounds, and, in fact, provide minimal risk of injury. A standard way of accomplishing this training without endangering the participants is the use of body armor and a weapon, which can fire a paint ball.

A paint ball is a breakable or frangible, hollow ball containing a paint or other colorant. When the paint ball strikes an object or a person, the ball can splatter leaving paint or other mark on the person or the object, thereby indicating a hit or a successful shot. This successful shot occurs without causing injury to the person, especially in view of the protective clothing and face guard, which a person must wear during such action for safety reasons.

The standard paint ball gun has a bolt action that fires the paint balls with air or other gas. The air flow is the critical feature of the paint ball firing in the proper fashion. An adjustment to the air flow can improve the paint ball flight. It is highly desired to provide a more efficient air flow in the gun, in order to permit the paint ball to have a more accurate flight.

In a pneumatic gun, such as those suitable for discharging paint balls, it is difficult to achieve the desired seal within the gun, so that the flow of air to properly direct the paint balls to the desired target. Paint ball guns are described in the many United States patents, such as U.S. Pat. No. 5,505,188 to Robert A. Williams.

Typically, a gun designed to shoot the paint balls has a chamber with a front and rear end. A gun barrel is supported by the body of the gun. The gun barrel is open on one end, and on the other has a closed chamber, such that a continuous bore is formed. Near the closed chamber, the ball is inserted in the bore, and a flow of air caused by pulling of a trigger permits the ball to be fired.

The flow of air and the force applied to the ball is critical to the effectiveness to the paint ball gun. The proper direction of the flow of air and the position of the ball in the chamber combined with the flow of air is the desired aspect of this matter. The flow of air to the paint ball passes through a bolt to the ball.

Use of the paint ball gun permits drilling for military or police personnel. These military or police force now can be faced with life threatening situations. In order to train to react quickly to prevent a hostile opponent actions, which may cause injury to the soldier or officers, target practice is required. The standard target practice neither tests nor improves the reaction time of a shooter. Nor does the target practice provide an urgency required in most hostile situations. There is no hostile opponent, and the standard target does not fire or shoot back.

There are electronic devices for measuring the reaction time of the shooter. However, due to the lack of return fire from an opponent, again the urgency is not present. It is desired to provide an apparatus suitable for use in interactive target practice. This permits the reaction time of the shooter to be tested without severe danger.

A suitable gun used for this purpose of testing reaction time is the paint ball gun. In the paint ball gun, a paint ball is discharged toward the target. Upon striking the target the paint ball ruptures and a hit or miss is indicated on the target.

The bolt for a paint gun is basically a cylindrical affair. Adjacent to end of the cylinder is paint ball chamber. As the paint ball is received in the chamber, air through the bolt forces the ball out of the barrel. The other end of the cylinder is adjacent to the pneumatic air supply. The pneumatic air supply forces air through the bolt and against the paint ball, in order to discharge or fire the same.

Since the target may be a person who also has a paint ball gun, the reaction time and the counter measures used by both the officer and the target can also be tested. With this test of reaction time comes a more accurate measure of combat danger, without the inherent danger of actual combat. It is desired to improve the accuracy in the paint ball gun and be as close to a standard weapon as possible.

One of the key factors in the functioning of a paint ball gun is the flow of air in the gun. If the flow of air can be adjusted appropriately, and the function of the gun be improved; the paint ball can be fired with more accuracy, and greater training advantages can be obtained with the use of a paint ball gun.

It is especially desirable to improve the paint ball gun and its accuracy, with a minimized effort. A complete redesign of the paint ball gun to achieve the accuracy is complicated and expensive. If such an improvement can be accomplished more simply, great advantages are obtained.

SUMMARY OF THE INVENTION

Among the many objectives of this invention is the provision of a shaped bolt to improve the airflow in a paint ball gun.

A further objective of this invention is the provision of a shaped bolt to improve the accuracy of a paint ball gun.

Yet a further objective of this invention is the provide a shaped bolt for use in a paint ball gun as a replacement part.

A still further objective of this invention is the provision of a shaped bolt to divide the air flow in a paint ball gun.

Also an objective of this invention is the provision of a shaped bolt to improve the effectiveness of a paint ball gun.

Another objective of this invention is the provision of a shaped bolt as a replacement part for a paint ball gun.

Yet another objective of this invention is the provision of a paint ball gun, for superior training.

These and other objectives of the invention (which other objectives become clear by consideration of the specification, claims and drawings as a whole) are met by providing a shaped bolt with the same outside appearance as a standard bolt, but with a torpedo end or angled flanged end adjacent to the air supply chamber, and a cross-flow end or trifurcated flow end oppositely disposed therefrom.

BRIEF DESCRIPTION OF THE DRAWINGS

Throughout the figures of the drawings, where the same part appears in more than one figure of the drawings, the same number is applied thereto.

DESCRIPTION OF THE PREFERRED EMBODIMENTS

With a modified bolt for a paint ball gun, the paint ball can be fired more efficiently. A bolt for a paint ball gun has the substantially same exterior shape as the prior art bolt, except for the distal end thereof. The interior shape of the bolt of this invention provides the improved air flow and more efficient paint ball gun. In the specific bolt of this invention for a paint ball gun, the interior shape of the bolt is rounded on the proximal end and the exterior shape of the bolt is rounded on the distal end.

On the outside of the bolt is a proximal flange adjacent to air supply. Oppositely disposed from the proximal flange and adjacent to the distal end of the bolt is the paint ball chamber. The air flows through the bolt to the ball. The bolt has a rounded, slotted distal end. The proximal exterior of the bolt includes an angled flange extending there around and the interior of the bolt includes a rod or torpedo having a smaller diameter than the distal end and having a rounded or pointed proximal end.

While it is not desired to bound by any particular theory, the following postulate is offered to explain the improvement in the firing of the paint ball.

As the air flow passes into the bolt and the annular space created between the outer cylinder and the torpedo, the air proceeds through the annular space to the slotted area. The torpedo is centrally mounted in the cylinder on a three spoked mount.

The three spoked mount receives the air and divides the air into three streams. The three streams contact the ball and force the paint ball out of the gun.

The bolt of this invention also has a reduced in diameter distal end 140. Such reduction in diameter is known to produce a venturi effect on air flowing therethrough and inherently decreases contact area on the surface of the ball 108. With the flow of air around the modified bolt interior, this rearrangement smooths out the flow of air through the gun and permits a more accurate flight path for the fired paint ball.

Figure 1:
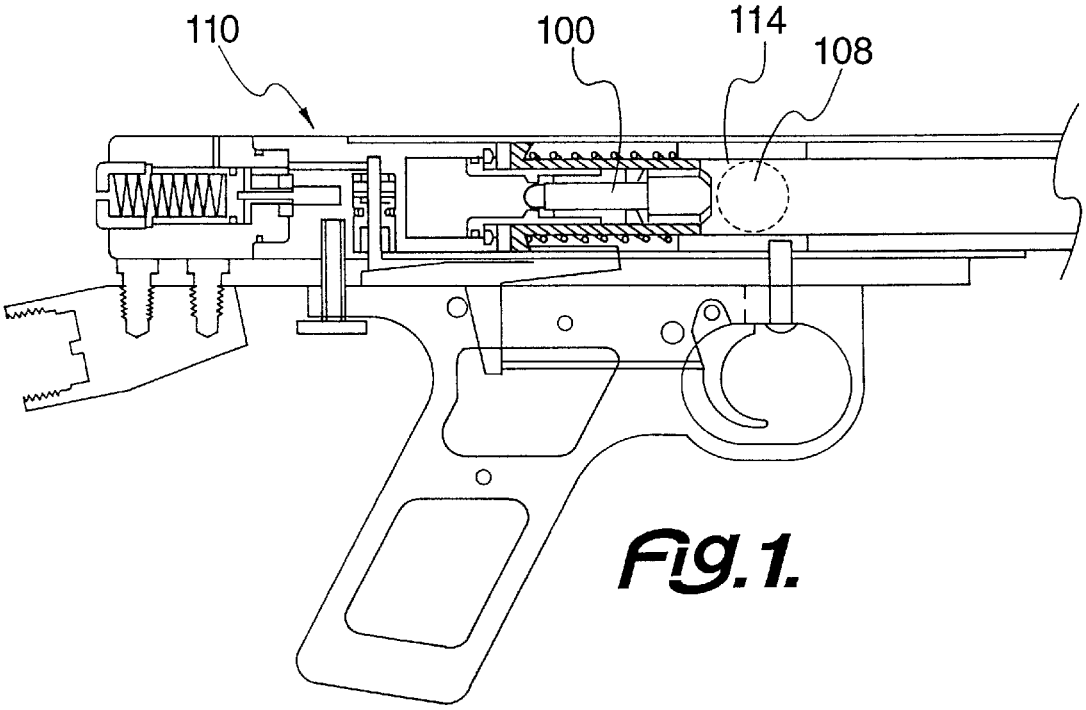
FIG. 1 depicts a shaped bolt 100 of this invention used in a paint ball gun 110, from a side partially, cross-sectioned view.

In FIG. 1, the shaped bolt 100 of this invention is mounted in the paint ball gun 110. Angled flanged proximal end 130 (FIG. 3) of shaped bolt 100 is adjacent to the air supply. Trifurcated flow distal end 140 is oppositely disposed from flanged proximal end 130 and adjacent to the gun ball chamber 114.

Figure 2:
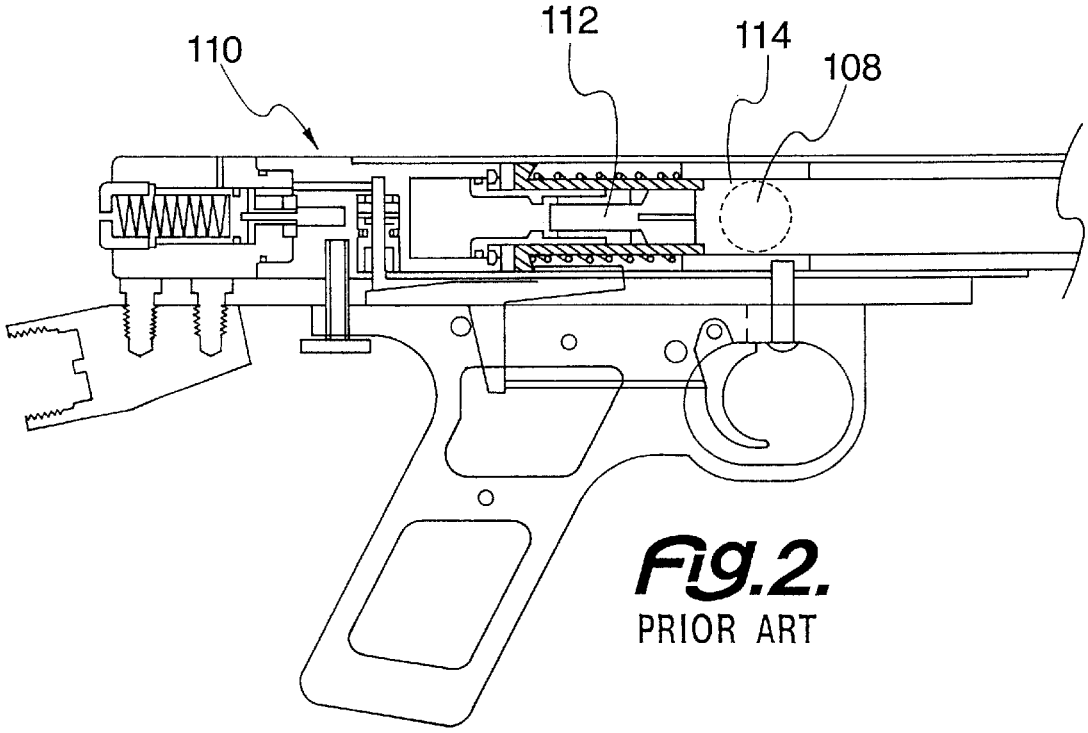
Fig.2. PRIOR ART
FIG. 2 depicts paint ball gun 110, from a side partially, cross-sectioned view, with a standard bolt 112, of the prior art.

With FIG. 2, the paint ball gun 110, has standard bolt 112, of the prior art mounted therein.

Figure 3:
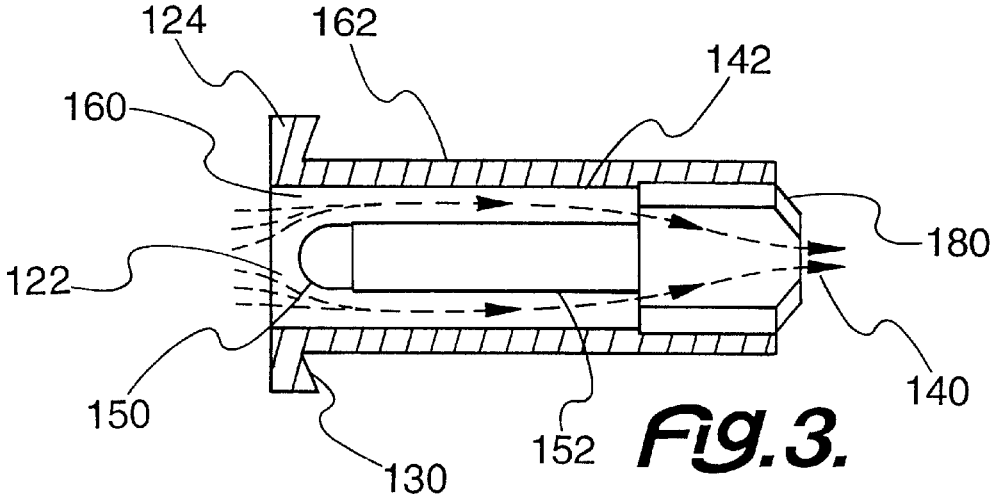
FIG. 3 depicts a side view of the shaped bolt 100 of this invention.
Figure 4:
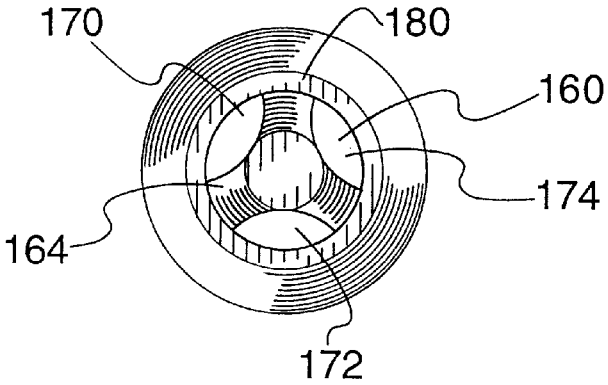
FIG. 4 depicts a front end, plan view of the shaped bolt 100 of this invention.
Figure 5:
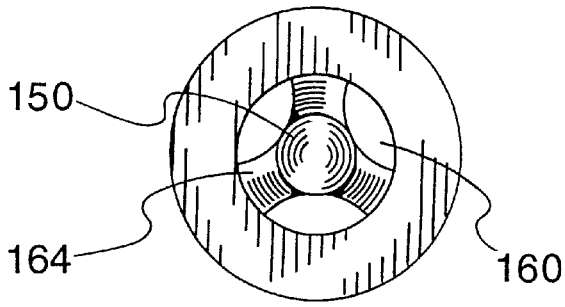
FIG. 5 depicts a rear end, plan view of the shaped bolt 100 of this invention.

FIG. 3, FIG. 4 and FIG. 5 combine to show the shaped bolt 100 of this invention. Shaped bolt 100 has the substantially same outer shape as the prior art bolt except for the configuration of distal end 140. The interior structure 122 enhances the improved air flow and more efficient paint ball gun 110.

On the outside of the rifled or shaped bolt 100 is a flange 124 adjacent to air supply (not shown) of gun 110. Oppositely disposed from the flange 124 and adjacent to the trifurcated end 140, the shaped bolt 100 is the paint ball chamber (not shown). The air flows through the shaped bolt 100 to the paint ball 108. It is the distal end 140 configuration of the shaped bolt 100 and its interior structure 122, which provides the improved air flow and more accurate paint ball 108 flight.

The modified, rifled, shaped bolt 100 of this invention has a reduced in diameter rounded and slotted distal end 140, and a pointed or most preferably rounded proximal end torpedo 150 extending toward flanged end 130. The torpedo 150 has a smaller outside diameter 152 than the interior diameter 142 of trifurcated end 140. This structure can achieve the desired air flow, which permits efficient discharge of the paint ball 108.

As the air flow passes into the shaped bolt 100 and the annular space 160 created between the outer cylinder 162 and the torpedo 150, the air flow proceeds through the annular space 160 to the slotted reduced in diameter distal trifurcated end 140. The torpedo 150 is centrally mounted in the outer cylinder 162 on a three spoked mount 164 which supports the torpedo 150 within the outer cylinder 162 and creates the modified distal end 140.

The diameter of the outer cylinder 162 is up to three times the diameter of torpedo 150. More preferably, the diameter of the outer cylinder 162 is up to 2.5 times the diameter of torpedo 150. Most preferably, the diameter of the outer cylinder 162 is about 1.5 to about 2.5 times the diameter of torpedo 150.

The three spoked mount 164 receives the air and divides the air into a first stream 170, a second stream 172, and a third stream 174, which exit the reduced in diameter distal end 140 and contact the paint ball over a smaller area thereof and forces the paint ball 108 out of the gun 110.

The bolt 100 of this invention has reduced in diameter rounded or sloped shoulder 180 at trifurcated end 140. The torpedo has a rounded hemispherical or even pointed proximal end. With the flow of air through the modified bolt, this rearrangement smooths out and speeds up the flow of air through the gun 100 and permits a more accurate flight path for the fired paint ball 108 by decreasing area of contact between the ball 108 and the air flow.

This application—taken as a whole with the specification, claims, abstract, and drawings—provides sufficient information for a person having ordinary skill in the art to practice the invention disclosed and claimed herein. Any measures necessary to practice this invention are well within the skill of a person having ordinary skill in this art after that person has made a careful study of this disclosure.

Because of this disclosure and solely because of this disclosure, modification of this method and apparatus can become clear to a person having ordinary skill in this particular art. Such modifications are clearly covered by this disclosure.

What is claimed and sought to be protected by Letters Patent of the United States is:

What is claimed is:

1. In a paint ball gun including a propelling bolt for directing an air flow to propel a paint ball, the improvement comprising:

(a) the propelling bolt having a modified exterior and interior to increase air flow against a dischargeable paint ball and to decrease the area of contact of the air flow against the paint ball;

(b) the propelling bolt having an exterior surface shaped to permit the propelling bolt to be received into the paint ball gun and having a distal end which is reduced in diameter relative to a cylinder defining the exterior surface of the bolt;

(c) the propelling bolt further including a torpedo within the cylinder and spaced inwardly therefrom and extending toward a proximal end of the bolt;

(d) the propelling bolt having a rounded cross-section in a transverse plane; and (e) the torpedo and cylinder defining an airflow space therebetween to allow air flow through the paint ball gun.

2. The paint ball gun of claim 1 further comprising:

(a) the distal end having a trifurcated slot assembly thereon; and (b) the torpedo having a hemispherical shaped proximal end and a diameter less than an outside diameter of the distal end.

3. The paint ball gun of claim 2 further comprising:

(a) the distal end communicating with the proximal end;

(b) the bolt having a hollow cylinder exterior shape with said torpedo defining an interior rod mounted therein; and (c) mounting means for the rod at the distal end which create the slotted reduced in diameter distal end.

4. The paint ball gun of claim 3 further comprising:

(a) the distal end being a reduced in diameter trifurcated end; and (b) the interior rod having a rounded proximal end.

5. The paint ball gun of claim 4 further comprising:

(a) the distal end comprising a rod mount having three spokes to support the rod;

(b) the spokes forming three air pathways therebetween to enhance propelling of the paint ball.

6. In a paint ball gun including a propelling bolt for directing air flow to propel a paint ball, the improvement comprising:

(a) the propelling bolt having a modified exterior and interior to enhance air flow against a dischargeable paint ball;

(b) the propelling bolt having an exterior surface adapted to permit the propelling bolt fit into the paint ball gun and having a distal end reduced in diameter relative to a cylinder defining the exterior surface of the bolt;

(c) the propelling bolt having a trifurcated distal end and a torpedo extending proximally within and spaced from an exterior cylinder of the bolt;

(d) the trifurcated distal end having a rounded cross-section in a transverse plane;

(e) the torpedo including a hemispherical shaped proximal end and having a rounded cross-section in a transverse plane;

(f) the torpedo being positioned inwardly spaced from the cylinder to create a path for air flow through the paint ball gun;

(g) the trifurcated distal end having a slot assembly thereon;

(h) the torpedo having a diameter less than an outside diameter of the slot assembly;

(i) the trifurcated distal end communicating with the proximal end;

(j) the propelling bolt having a hollow cylinder exterior shape with said torpedo defining a rod mounted therein;

(k) mounting means for the rod at the trifurcated distal end;

(l) the trifurcated distal end comprising a mount having three spokes to support the rod; and (m) the spokes forming three air pathways therebetween to enhance propelling of the paint ball.

* * * * *